US007216633B2

(12) United States Patent
Attwood et al.

(10) Patent No.: US 7,216,633 B2
(45) Date of Patent: May 15, 2007

(54) TRANSFER JET PUMP PRIME RESERVOIR WITH INTEGRATED ANTI-SIPHON VALVE FEATURE

(75) Inventors: William E Attwood, Lasalle (CA); Patrick K Powell, Farmington, MI (US)

(73) Assignee: Denso International America, Inc., Southfield, MI (US)

( * ) Notice: Subject to any disclaimer, the term of this patent is extended or adjusted under 35 U.S.C. 154(b) by 0 days.

(21) Appl. No.: 11/232,376

(22) Filed: Sep. 21, 2005

(65) Prior Publication Data

US 2007/0062492 A1 Mar. 22, 2007

(51) Int. Cl.
*F02M 37/04* (2006.01)
*F02M 37/08* (2006.01)

(52) U.S. Cl. ..... 123/509; 137/571

(58) Field of Classification Search ..... 123/509, 123/510, 511, 514; 137/574, 571, 576, 565.22
See application file for complete search history.

(56) References Cited

U.S. PATENT DOCUMENTS 5,197,444 A * 3/1993 Lang et al. ..... 123/514
5,564,397 A * 10/1996 Kleppner et al. ..... 123/514
5,782,223 A * 7/1998 Yamashita et al. ..... 123/510
5,797,373 A * 8/1998 Kleppner et al. ..... 123/495
6,273,131 B1 * 8/2001 Kleppner ..... 137/565.22
6,871,640 B2 3/2005 Atwood et al.
6,907,899 B2 * 6/2005 Yu et al. ..... 137/565.22
6,981,490 B2 * 1/2006 Nagata et al. ..... 123/514
6,997,168 B2 * 2/2006 Schueler et al. ..... 123/497
7,066,153 B2 * 6/2006 Vitalis et al. ..... 123/514
2003/0159681 A1 * 8/2003 Schueler et al. ..... 123/514
2004/0177886 A1 * 9/2004 Nagata et al. ..... 137/571

* cited by examiner

*Primary Examiner*—Mahmoud Gimie
(74) *Attorney, Agent, or Firm*—Harness, Dickey & Pierce, P.L.C.

(57) ABSTRACT

A movable fuel valve lies within a housing at an end of a housing fuel passage. A fuel tube has a nozzle end inserted within a first end of the housing fuel passage while the movable valve element is situated at a second end of the housing fuel passage and controls fuel flow from the second end of the housing fuel passage. The nozzle end remains surrounded in fuel when the valve element is closed and sealed against the second end of the housing fuel passage. When the fuel pressure within the housing fuel passage is greater than a fuel pressure on the other side of the valve, the fuel flows from the housing fuel passage, through the part of the housing surrounding the valve, and into the reservoir. The movable valve element prevents fuel from flowing from the main-side of a fuel tank to the sub side of the tank.

16 Claims, 5 Drawing Sheets

TRANSFER JET PUMP PRIME RESERVOIR WITH INTEGRATED ANTI-SIPHON VALVE FEATURE

FIELD OF THE INVENTION

The present invention relates to fuel pump module jet pumps, and more specifically, to the reservoir area surrounding the jet nozzle and an integrated anti-siphon valve.

BACKGROUND OF THE INVENTION

Devices for transferring fuel within an automobile fuel tank are known in the art. In one instance, in a saddle-type fuel tank, fuel may be siphoned between a fuel tank main side, which contains the fuel pump module that pumps liquid fuel to the engine, and a fuel tank sub side. To maintain an uninterrupted supply of fuel to the engine, the jet pump of the fuel pump module must be submerged in fuel at all times to maintain its primed state in order to transfer fuel from the sub-side to the main side via siphoning. If the jet pump of the fuel pump module is not maintained in a primed condition, siphoning may not be maintained, and thus, the uninterrupted supply of fuel to the engine may not be maintained.

During instances of quick maneuvering, sloshing of fuel from the fuel tank main side to the fuel tank sub side may occur. When this occurs, an instant imbalance of fuel levels between the saddles of the fuel tank occurs. While current transfer lines between the saddles of the tank are designed to deliver fuel to the main side, this process may be slow depending upon the size of the transfer line. Additionally, if the main side has sloshed enough fuel to the sub side, then the prime state may be lost. Ultimately, this may result in losing the uninterrupted supply of fuel to the engine, even when the fuel tank sub side has fuel to be siphoned to the main side.

Furthermore, if fuel sloshing occurs from the sub side to the main side, thereby creating unequal fuel levels between the saddle tanks, current fuel tank transfer lines will transfer fuel from the main side to the sub side, which is an unnecessary event since fuel on the main side will eventually be pumped to the engine to be used in combustion.

Therefore, a need remains in the art for a saddle tank fuel siphon transfer line that maintains its fuel prime condition on the main side of the tank in preparedness for transferring fuel from the sub side to the main side to maintain fuel on the main side of the fuel tank when the fuel level on the sub side is higher than on the main side, such as immediately after a fuel sloshing event from the tank main side to the tank sub side.

SUMMARY OF THE INVENTION

In accordance with the teachings of the invention, a transfer jet pump prime reservoir with an integrated anti-siphon valve feature may have a housing with a fuel passage, into which a fuel tube nozzle seals. A movable valve element may be situated at a second end of the housing fuel passage to control fuel flow from the housing fuel passage that flows into the reservoir. The valve's movable valve element may have a pliable sealing element to form a seal with the second end of the housing fuel passage, a part of which is encased within the housing.

The housing may be fastened to a top side of the fuel pump module reservoir, or a similarly convenient and functional location, and when the fuel pressure within the housing fuel passage is greater than a fuel pressure outside the housing fuel passage, fuel flows from the housing fuel passage and into the reservoir through the open valve element. Fuel exiting the housing fuel passage flows through the housing and into the fuel reservoir. By this arrangement, the nozzle end remains surrounded in fuel when the valve element is sealed against the housing fuel passage. The movable valve element acts as an anti-siphon valve to prevent fuel from flowing from a fuel tank main side to a fuel tank sub side.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Some automobiles, and more specifically, sports cars and sport sedans, are rear wheel drive vehicles having a drive shaft running between an engine located in the front of the vehicle, and a rear differential located in the rear of the vehicle. Like most vehicles, these sports cars and sport sedans have a rearward mounted fuel tank. However, because the driveshaft and the fuel tank must share rearward space, many fuel tanks on these types of vehicles must be separated into two main areas bridged with a tank area between them, with the driveshaft running between the two main tank areas. The division of the fuel tank, and more specifically, transferring fuel between the two main areas, has lead to the development of the teachings of the present invention, which will be explained below using FIGS. 1–12.

Figure 1:
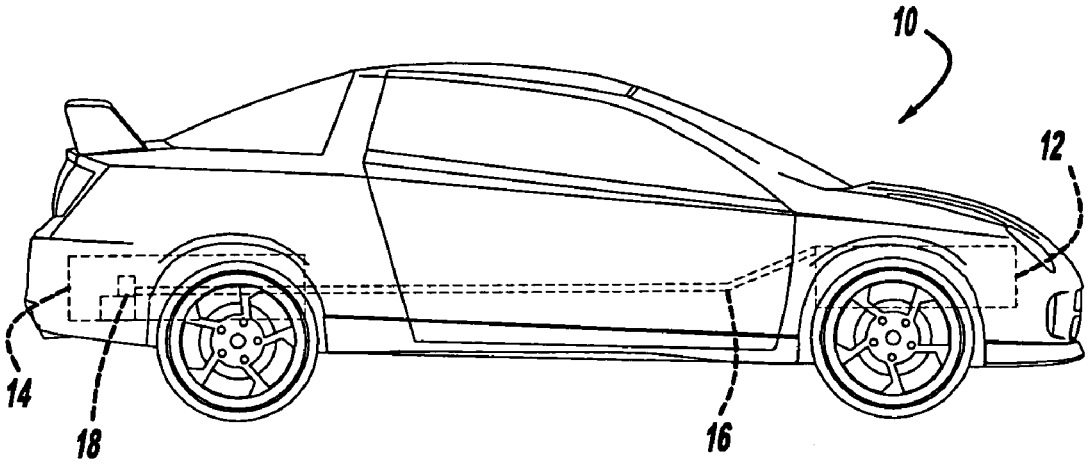
FIG. 1 is side view of an automobile depicting a fuel system in phantom according to the teachings of the present invention.
Figure 2:
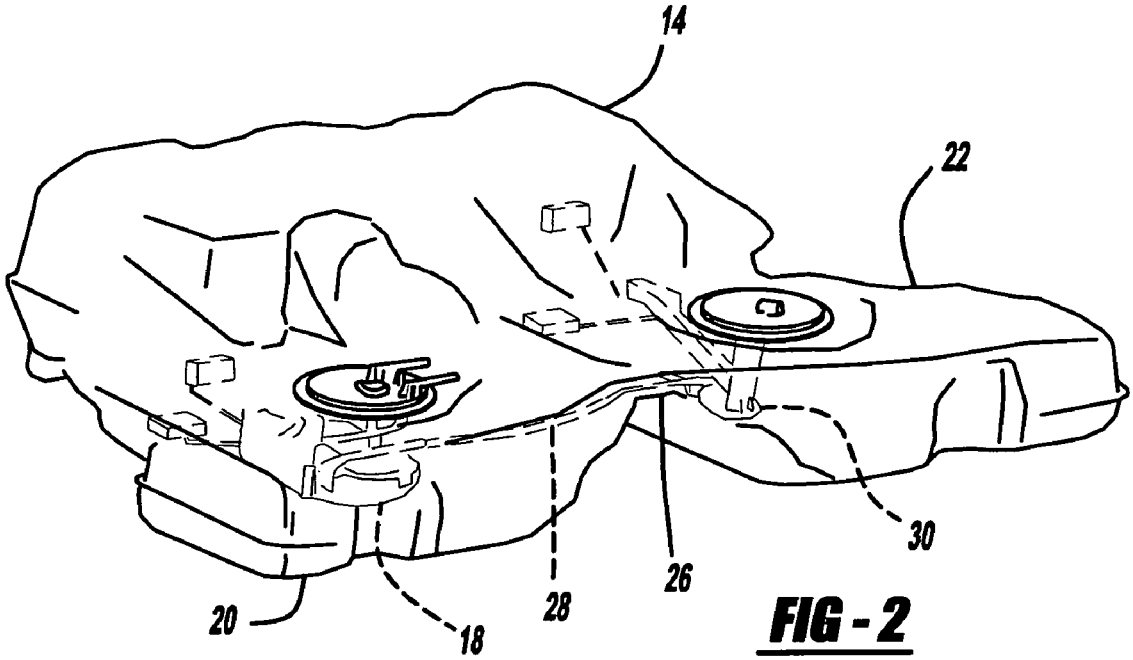
FIG. 2 is a perspective view of a saddle style fuel tank depicting a fuel pump module and a siphon transfer line between the saddles according to the teachings of the present invention.

Turning now to FIG. 1, an automobile 10 employs an engine 12, a fuel tank 14, and a fuel line 16 running from the engine 12 to the fuel tank 14 to supply the engine 12 with fuel that is pumped from a fuel pump module 18. With reference to FIG. 2, an arrangement of the operative workings of the saddle fuel tank 14 will be explained. The saddle fuel tank 14 is primarily composed of two large fuel holding areas, a fuel tank main side 20 and a fuel tank sub side 22. The main side 20 houses the fuel pump module 18 that is responsible for pumping fuel from the main side 20 through the fuel pump module outlet 24 (FIG. 3), which is connected to the fuel line 16. The main side 20 and sub side 22 are bridged by a fuel tank bridge 26, which contains an internal siphon transfer line 28 used to siphon fuel between the main side 20 and a sub side 22. The fuel tank bridge 26 provides a cavern between the main side 20 and the sub side 22 of the fuel tank 14, while the internal siphon transfer line 28 provides a direct fuel tube link between the sub side transfer module 30 and the main side fuel pump module 18.

Figure 3:
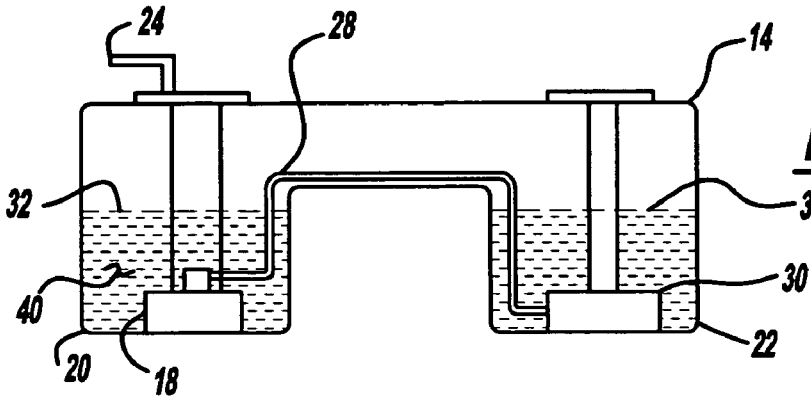
FIG. 3 is an explanatory view of a saddle style fuel tank depicting fuel levels in the saddles and a siphon transfer line running between the saddles.

FIGS. 3 through 6 depict a fuel transfer scenario that may occur in a saddle style fuel tank 14 and prompted the teachings of the present invention. FIG. 3 depicts a fuel tank 14 in which the fuel levels 32, 34 are equal on opposing sides of the tank 14, that is, the level in the tank main side 20 is equal to the level in the tank sub side 22. The fuel levels 32, 34 of FIG. 3 are fuel levels that a vehicle might experience when the vehicle travels in a straight line or rather, is not experiencing any cornering events. In such a fuel tank 14, the fuel 40 in the main side 20 is pumped by the fuel pump module 18 to the engine 12 via the fuel outlet 24 and the fuel line 16.

Figure 4:
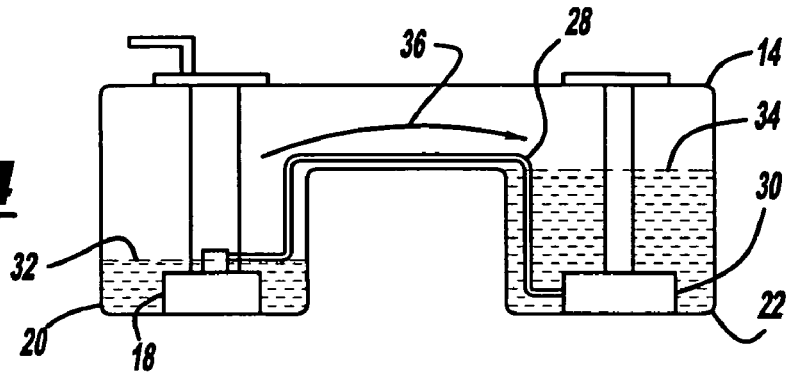
FIG. 4 is an explanatory view of a saddle style fuel tank depicting fuel movement and levels in the saddles and a siphon transfer line running between the saddles.
Figure 5:
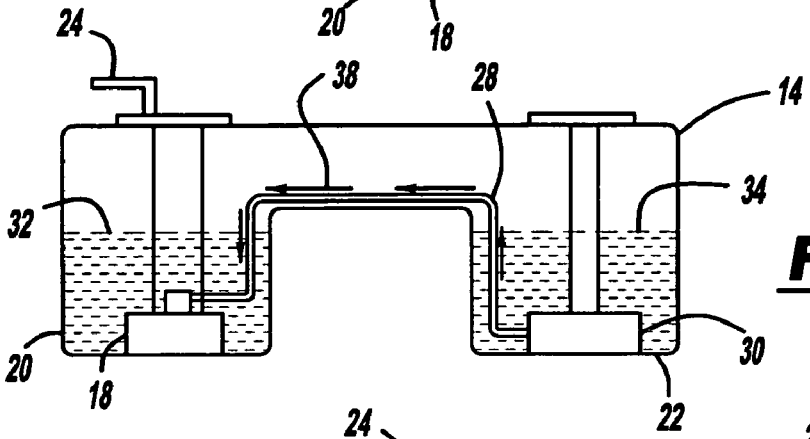
FIG. 5 is an explanatory view of a saddle style fuel tank depicting fuel levels in the saddles and fuel transferring in a siphon transfer line running between the saddles.

During the pumping of fuel 40 from the tank main side 20 to the engine 12, the fuel level 32 may eventually be reduced to the level depicted in FIG. 4. In another scenario, the fuel level of the tank main side 20 may be significantly reduced in just a few seconds if the vehicle 10 experiences quick, hard cornering in a particular direction. For instance, if the vehicle of FIG. 1 undergoes particular cornering at an elevated speed, the fuel levels of FIG. 4 may result. Specifically, the fuel from the tank main side 20 may slosh or transfer to the tank sub side 22 via the fuel tank bridge 26 due to the lateral forces and lateral g's involved in such a cornering maneuver. When this occurs, the fuel pump module 18, and more specifically, the jet pump, may not be submerged in fuel for a period of time before fuel is transferred by the siphon transfer line 28 from the tank sub side 22 to the tank main side 20, as depicted in FIG. 5, to equalize the fuel levels once again. Such a fuel transfer takes place only when the fuel transfer line 28 is primed with fuel.

In order to ensure that the transfer line remains primed with fuel and that fuel transfer via siphoning is possible via the internal fuel transfer siphon line 28, the teachings of the present invention are invoked. With continued reference to FIGS. 1 through 6, and more specific reference to FIGS. 7–12, the operative workings of the teachings of the present invention will be explained.

Figure 7:
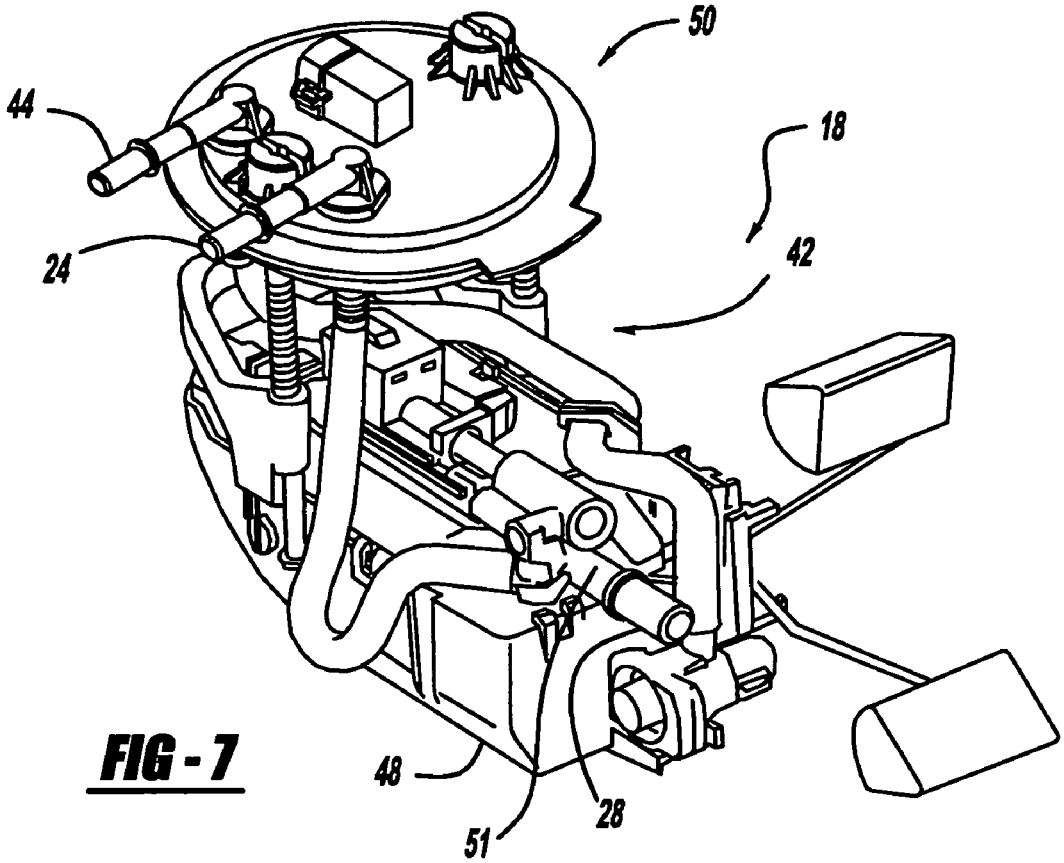
FIG. 7 is a top perspective view of a fuel pump module depicting a jet pump module prime reservoir according to the teachings of the present invention.
Figure 8:
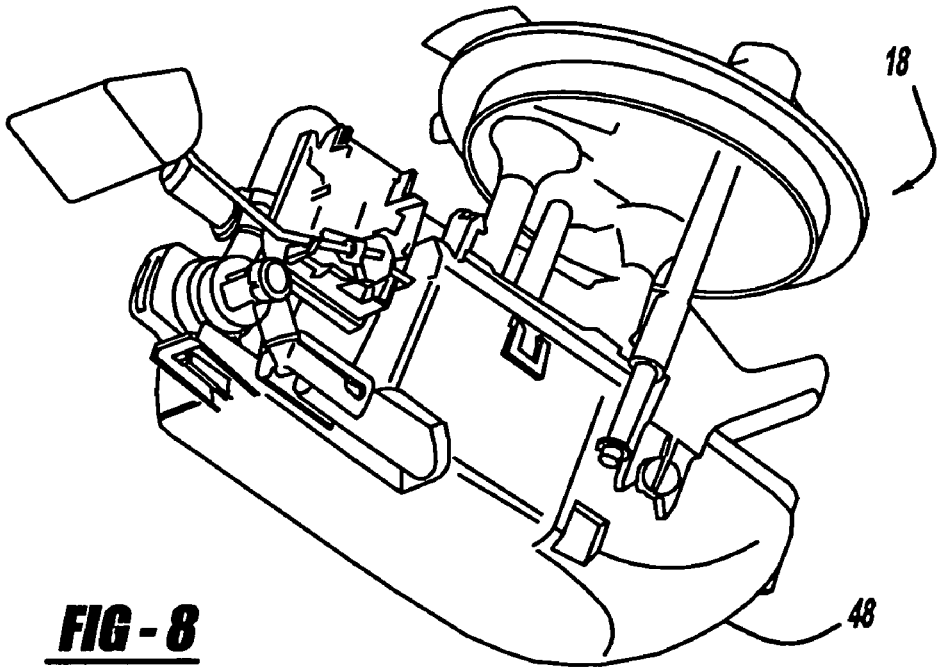
FIG. 8 is a bottom perspective view of a fuel pump module according to the teachings of the present invention.

FIG. 7 depicts a fuel pump module 18 to which an anti-siphon transfer jet pump 42 (FIG. 9), according to teachings of the present invention, is attached. FIG. 8 depicts the underside of the fuel pump module 18, revealing the fuel pump module reservoir 48 that maintains a source of fuel for the fuel pump module 18. The fuel pump module 18 also has a flange 50, a fuel inlet 44 and a fuel outlet 24.

Figure 9:
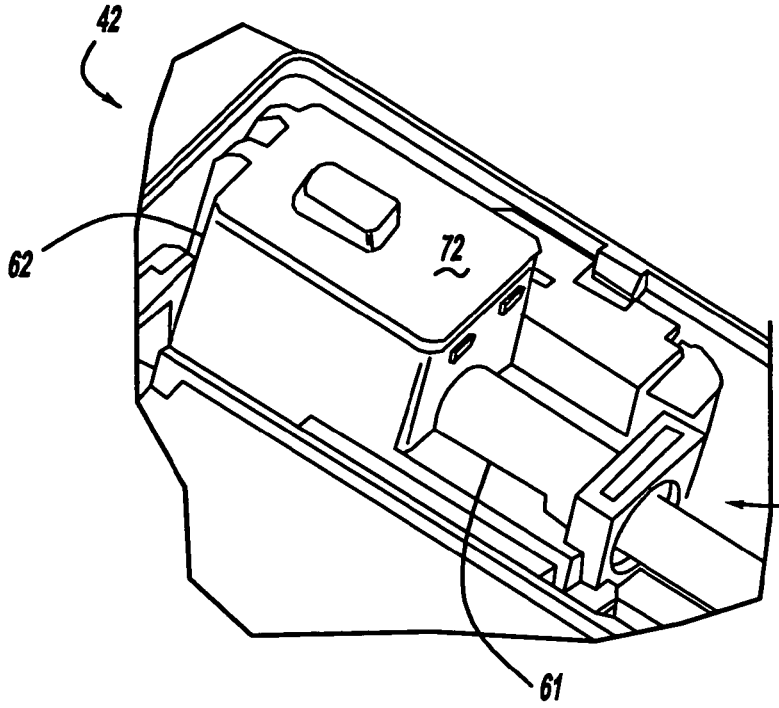
FIG. 9 is a top perspective view of a jet pump module prime reservoir according to the teachings of the present invention.

Turning now to FIG. 9, the operative workings of the teachings of the present invention will be described. FIG. 9 depicts a fuel transfer jet pump prime reservoir with an integrated anti-siphon valve 42. Individually, the jet pump 51, prime reservoir 62 and flapper valve 64 (FIG. 10) generally make up the fuel transfer jet pump prime reservoir with an anti-siphon valve 42; however, all of the components associated with the device 42 will be explained with reference to FIGS. 1–12, with FIGS. 9–12 being used for specific operation of the fuel transfer jet pump prime reservoir with an integrated anti-siphon valve 42.

When the fuel in the fuel tank 14 sloshes or splashes to the sub side 22 of the tank 14, due to hard cornering for example, as depicted by slosh direction arrow 36, transfer of that sloshed fuel back to the main tank side 20 is desirable so that the fuel pump module 18 can utilize the fuel by pumping it to the engine 12 for combustion. A low fuel situation is noted in FIG. 4. Transferring the fuel becomes necessary, via siphoning, in order to transfer the fuel back to the main side 20 via fuel line 28, as depicted in FIG. 5 by the fuel transfer direction arrow 38.

To successfully transfer the fuel from the sub side 22 to the main side 20, both ends of the siphon transfer line 28 must remain primed. As depicted in FIGS. 3–6, since the end of the transfer line 28 remains very close to the bottom of the tank sub side 22, it remains primed, which means that it remains surrounded by fuel. However, due to the presence of the fuel pump module 18, the fuel pump (not shown), and the arrangement of such in the tank main side 20, the end of the transfer line 28 may be farther from the bottom of the tank main side 20, and may be susceptible to losing its primed condition.

When the fuel level situation of FIG. 4 is present, that is, the tank sub side 22 level is higher than the tank main side 20 level, fuel siphoning from the sub side 22 to the main side 20 will occur. An advantage of the teachings of the present invention is that once fuel is transferred to the main side 20 via the transfer line 28, it cannot transfer back to the sub side 22 via the transfer line 28. This advantage is the anti-siphon feature of the jet pump prime reservoir. Another advantage is that because both ends of the transfer line 28 remain primed, the fuel transfer from the sub side 22 to the main side 20 is instantaneous and continuous when the difference between fuel levels, that is, the level of the sub side is higher than the main side, dictates such a fuel transfer. Such an instantaneous and continuous transfer is possible via a gravity feed siphoning process since the entire transfer line 28 remains primed with fuel.

Figure 10:
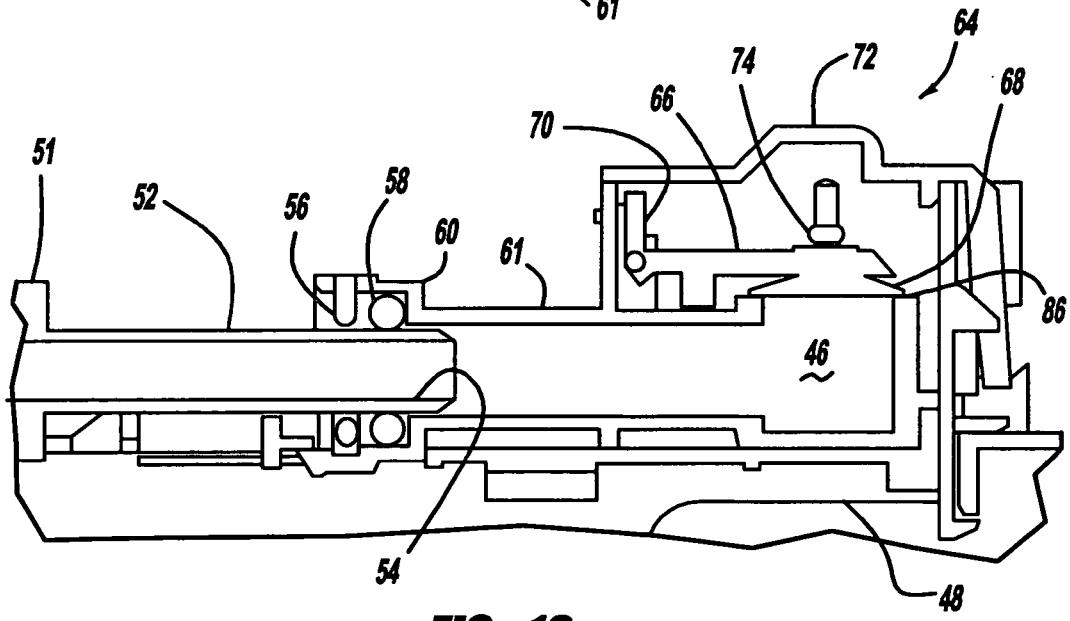
FIG. 10 is a cross-sectional view of a jet pump module prime reservoir depicting a closed anti-siphon valve according to the teachings of the present invention.
Figure 11:
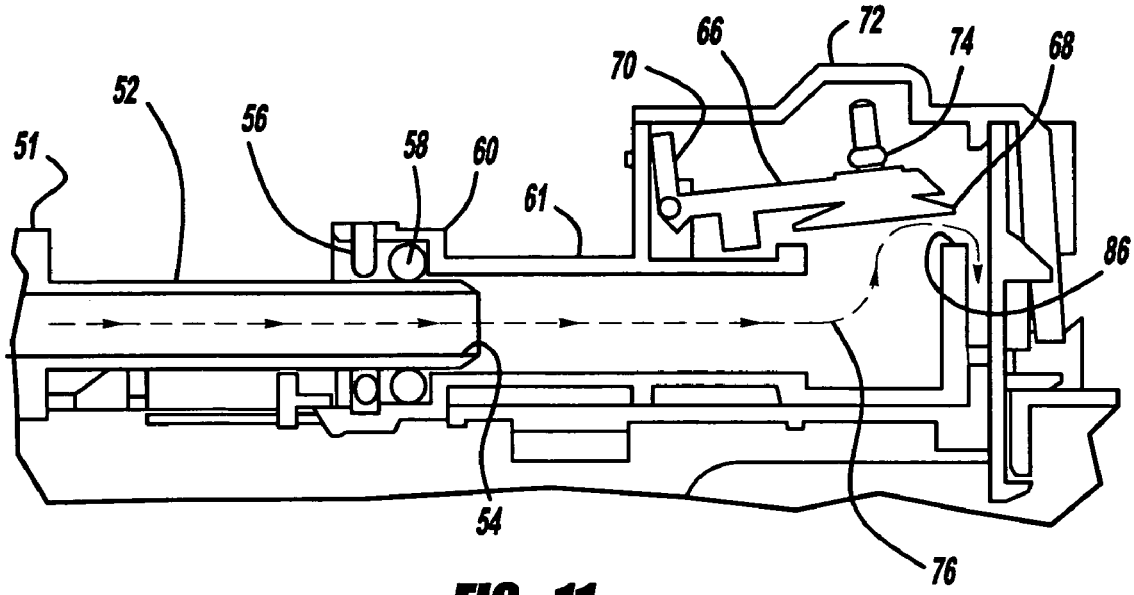
FIG. 11 is a cross-sectional view of a jet pump module prime reservoir depicting an open anti-siphon valve according to the teachings of the present invention.

Before the specific operation of the fuel transfer jet pump prime reservoir with an integrated anti-siphon valve 42 is explained, its construction will be described. With reference to FIGS. 10 and 11, the fuel transfer jet pump prime reservoir with an integrated anti-siphon valve 42 has a jet pump 51, located at an end that is connected to a jet tube 52, which has a nozzle 54. The nozzle 54 has a slight radius at its exit point to facilitate easier flow into the jet pump box tube 61. The jet pump box tube 61 is also known as the jet pump housing tube 61 or valve housing tube 61. The jet pump box 60 surrounds the nozzle 54 of the jet tube 52 and with its slightly larger diameter than the jet pump box tube 61, contains a clip 56 and an O-ring 58. The clip 56 secures the jet pump box tube 61 to the jet tube 52, while the O-ring 58 creates a seal around the nozzle end of the jet tube 52 between the clip 56 and the nozzle 54.

Further along the jet pump box tube 61 is a jet pump box tube sealing surface 86 that forms a fuel outlet of the jet pump box tube 61. Against this box tube sealing surface 61 abuts a seal 68 of a valve stem 66. Together the stem 66, seal 68, and sealing surface 86 form a movable valve element or flapper valve 64. Additionally, the stem 66 may have a stem post 70 that meets the stem 66 to form a stopper together with the back wall 78 of the jet pump prime reservoir 62.

Figure 12:
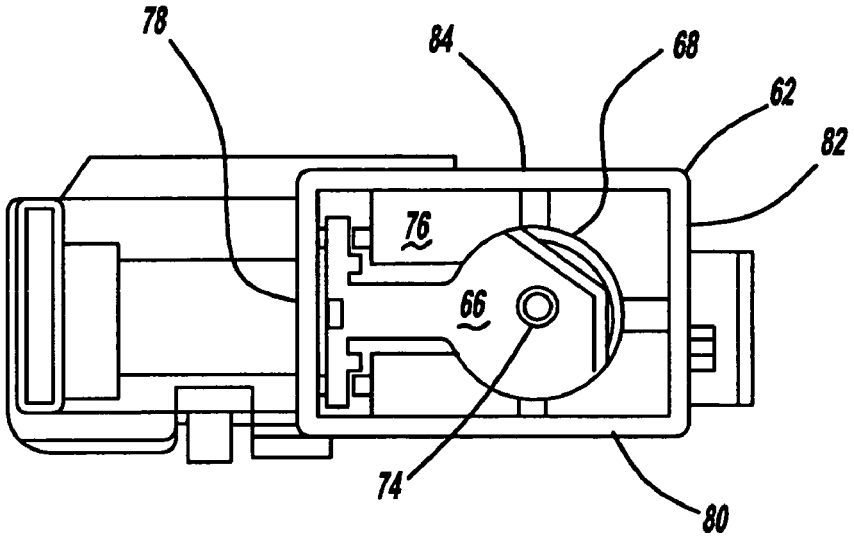
FIG. 12 is a top view of a jet pump module prime reservoir depicting an anti-siphon valve and a fuel flow-through area according to the teachings of the present invention.

Enclosing the flapper valve 64 are the walls of the jet pump prime reservoir 62. With reference to FIG. 12, a top view of the jet pump prime reservoir 62 will further explain its construction. The jet pump prime reservoir 62 may be comprised of four sidewalls. These walls are a back wall 78 located adjacent the jet pump box tube 61, a first sidewall 80, a second sidewall 84, and a front wall 82. The jet pump prime reservoir 62 has a cap 72 which seals the top of the reservoir. The cap 72 is generally L-shaped and extends over the front wall 82 of the jet pump prime reservoir 62. Within the jet pump prime reservoir 62 is the valve stem 66 with its abutting seal 68. As previously stated, the seal 68 abuts against the box tube sealing surface 86. To secure the seal 68 to the stem 66, the seal 68 passes through the stem and is secured by an enlarged seal portion 74. The stem 66 has a stem post 70 that may perpendicularly abut and fasten to the stem 66. The stem post 70 limits the degree of opening of the flapper valve 64 by abutting against the back wall 78.

How the one-way transfer occurs will now be explained with reference to FIGS. 4, 5 and FIGS. 10–12. When the fuel level of the sub side 22 is higher than the fuel level of the main tank main side 20, as depicted in FIG. 4, transfer, via siphoning, of fuel from the tank sub side 22 to the main side 20 will occur by the force due to gravity. Fuel begins to flow because the fuel height and thus the fuel pressure, is greater on the tank sub side 22 than on the tank main side 20 and because both ends of the transfer line 28 are in a primed condition with the transfer line 28 remaining full of fuel.

More specifically, fuel begins to move from the tank sub side 22 through the transfer line 28 according to the directional arrow 38 and into the tank main side 20. The fuel arrives at the fuel pump module 18 on the tank main side 20 and flows into the jet pump 51, and more specifically into the jet tube 52. The fuel flows from the nozzle 54 and into the jet pump box tube 61. Because the pressure is greater in the tank sub side 22 than the tank main side 20, the flapper valve 64 will open, permitting fuel to flow according to the fuel flow route 76 depicted in FIG. 11. As shown, when the flapper valve 64 opens, the stem 66 and seal 68 lift from the box tube sealing surface 86 to the extent that the stem post 70 will permit. The fuel flows over the box tube sealing surface 86 and through the opening 76 and into the fuel pump module reservoir 48 via a hole in the top of the fuel pump module reservoir 48 over which the prime reservoir 62 is located.

The fuel will continue to flow as depicted by the fuel directional arrow 38 until the fuel levels are of equal height, as depicted in FIG. 5. At this point, the fuel levels and pressures are equal and fuel flow halts. Upon equalization of fuel levels, the flapper valve 64 closes, resulting in the seal 68 abutting against the box tube sealing surface 86.

Figure 6:
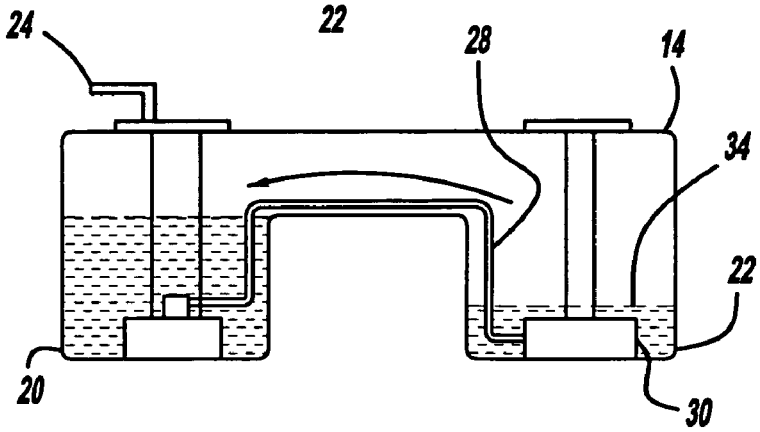
FIG. 6 is an explanatory view of a saddle style fuel tank depicting fuel movement and levels in the saddles and a siphon transfer line running between the saddles.

The flapper valve's one-way feature will now be described. When the fuel levels of FIG. 6 are evident, the fuel in the tank main side 20 is higher than the fuel in the tank sub side 22. This causes the fuel pressure at the flapper valve 64 to be higher on the flapper valve stem 66 side than on the flapper valve seal 68 side. More specifically, the fuel pressure above the stem 66 is greater than the fuel pressure within the jet pump box tube 61, and thus the flapper valve 68 is forced to remain in its closed position, as depicted in FIG. 10. Because of the closed flapper valve, no fuel will transfer through the transfer line 28 and the fuel levels depicted in FIG. 6 exist.

The advantage of the fuel levels depicted in FIG. 6 as a result of the transfer jet pump with prime reservoir 42 are such that fuel remains ready to be pumped from the fuel pump module 18 to the engine 12. Fuel that is sloshed to the tank main side 20 from the tank sub side 22 and does not siphon out of the tank main side 20 exemplifies the operability of the anti-siphon valve feature of the transferred jet pump prime reservoir according to the teachings of the present invention. Furthermore, in the event that an automobile, in which the transfer jet pump 42 is installed, corners hard such as during a racing event, for example, and additional fuel sloshes from the tank sub side 22 to the tank main side 20, the fuel will remain in the tank main side 20, thereby supplying a continuous flow rate of fuel to the engine 12, as the fuel is demanded. However, in the event that the automobile in which this system is installed makes a cornering event to cause the fuel level situation of FIG. 4 to occur, that is with fuel being sloshed from the tank main side to the tank sub side 22, the transfer of fuel from the tank sub side 22 through the transfer line 28 and into the tank main side 20 will immediately begin because both ends of the fuel transfer line 28 will remain primed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel valve apparatus comprising:

a housing, located in a tank main side of a saddle fuel tank, having a housing fuel passage that receives fuel from a tank sub side;

a fuel tube, the fuel tube having a nozzle end sealably positioned within a first end of the housing fuel passage; and a movable valve element with an attached separate pliable sealing element situated at a second end of the housing fuel passage to form a seal with the second end of the housing fuel passage to control fuel flow from the housing fuel passage and prevent fuel backflow to the tank sub side.

2. The valve of claim 1, wherein the movable valve element opens in one direction.

3. The valve of claim 1, further comprising:

a fuel pump module reservoir, wherein the housing and a housing fuel passage wall define a liquid flow passage into the fuel pump module reservoir.

4. The valve of claim 1, wherein the movable valve element further comprises:

a valve stem; and a stem post, the stem post joined to the valve stem to limit opening of the valve stem.

5. The valve of claim 4, further comprising:

a fuel pump module reservoir; and a housing fuel passage wall and a housing front wall, wherein when the valve element is in an open position, fuel flows into the fuel pump module reservoir via a path defined by the housing fuel passage wall and the housing front wall.

6. The valve of claim 1, further comprising:

a jet pump; and a fuel transfer line, wherein the fuel transfer line attaches to the jet pump and transfers fuel from a tank sub side of the saddle fuel tank to the jet pump on the tank main side of the saddle fuel tank.

7. A jet pump prime valve for transferring fuel between a sub side of a saddle fuel tank to a main side of the saddle fuel tank, the valve comprising:

a jet pump fuel tube;

a jet pump nozzle at a first end of the jet pump fuel tube;

a fuel transfer line, the fuel transfer line running from the sub side of the saddle fuel tank to the main side of the saddle fuel tank and connecting to the jet pump fuel tube;

a valve housing;

a valve housing tube interposed within the valve housing and also between the valve housing and the jet pump nozzle, the valve housing tube receiving the jet pump nozzle; and a valve element situated at an opposite end of the valve housing tube as the jet pump nozzle, the valve element further comprising:

a valve stem;

a pliable seal attached to the valve stem, the pliable seal abutting an end of the valve housing tube when the valve element is closed; and a stem post, the stem post joined to the valve stem to limit opening of the valve stem.

8. The jet pump prime valve of claim 7, wherein an open valve element permits fuel to flow from the valve housing tube when the fuel pressure within the valve housing tube is greater than a fuel pressure on an opposing side of the valve housing tube.

9. The jet pump prime valve of claim 7, further comprising:

a fuel pump module reservoir, wherein the valve housing and the valve housing tube define a fluid passage to the fuel pump module reservoir such that fuel flows from the valve housing tube into the fuel pump module reservoir.

10. A transfer jet pump prime reservoir with integrated anti-siphon valve for a saddle fuel tank system, comprising:

a fuel transfer line, the fuel transfer line running from a sub side of the saddle fuel tank to a main side of the saddle fuel tank;

a jet pump fuel tube first end attached to the fuel transfer line on the main side of the saddle fuel tank;

a jet pump fuel tube second end situated within a valve housing tube first end, a valve housing tube second end situated within a valve housing;

a valve element situated at an opposite end of the valve housing tube as the jet pump fuel tube; and an anti-siphon valve positioned at the valve housing tube second end, wherein fuel flows from the sub side of the saddle tank to the main side when a fuel level in the sub side is higher than the main side.

11. The system of claim 10, wherein the jet pump fuel tube second end is a nozzle.

12. The system of claim 10, further comprising:

a valve housing that surrounds the anti-siphon valve on four sides; and a valve housing cap that covers the valve housing.

13. The system of claim 12, further comprising:

a fuel flow passage defined between the valve housing and the valve housing tube, wherein fuel from the anti-siphon valve flows through the fuel flow passage.

14. The system of claim 13, wherein fuel flows from the anti-siphon valve when a fuel pressure within the valve housing tube is greater than a fuel pressure within the valve housing.

15. The system of claim 13, wherein when the anti-siphon valve remains closed when a fuel pressure within the valve housing tube is lower than a fuel pressure within the valve housing.

16. The system of claim 10, wherein the fuel transfer line and the jet pump fuel tube second end remain primed with fuel to support fuel transfer when the anti-siphon valve is in an open or closed position.

* * * * *